US011591874B2

(12) United States Patent
Krupski et al.

(10) Patent No.: US 11,591,874 B2
(45) Date of Patent: Feb. 28, 2023

(54) PACKER AND METHOD OF ISOLATING PRODUCTION ZONES

(71) Applicant: Viking Completion Technology FZCo, Dubai (AE)

(72) Inventors: Bartosz Krupski, Dubai (AE); Simon Peter Leiper, Dubai (AE); David Mills, Dubai (AE); William Morrison, Dubai (AE)

(73) Assignee: VIKING COMPLETION TECHNOLOGY FZCO, Dubai (AE)

( * ) Notice: Subject to any disclaimer, the term of this patent is extended or adjusted under 35 U.S.C. 154(b) by 0 days.

(21) Appl. No.: 17/511,023

(22) Filed: Oct. 26, 2021

(65) Prior Publication Data

US 2022/0136351 A1 May 5, 2022

(30) Foreign Application Priority Data

Nov. 4, 2020 (GB) ..... 2017446

(51) Int. Cl.
*E21B 23/06* (2006.01)
*E21B 33/129* (2006.01)

(52) U.S. Cl.
CPC ..... *E21B 23/06* (2013.01); *E21B 33/129* (2013.01)

(58) Field of Classification Search
CPC ..... E21B 23/06; E21B 22/129
See application file for complete search history.

(56) References Cited

U.S. PATENT DOCUMENTS 3,167,127 A 1/1965 Sizer
3,858,648 A 1/1975 Jett
4,018,272 A 4/1977 Brown et al.
(Continued)

FOREIGN PATENT DOCUMENTS

WO WO 2018/069683 A1 4/2018

OTHER PUBLICATIONS

Intellectual Property Office of the UK Patent Office; Search Report for GB2017446.2, claims 1-16; one page; dated Apr. 13, 2021; Intellectual Property Office of the UK Patent Office, Newport, South Wales, United Kingdom.

(Continued)

*Primary Examiner* — D. Andrews
*Assistant Examiner* — Ronald R Runyan
(74) *Attorney, Agent, or Firm* — Law Office of Jesse D. Lambert, LLC

(57) ABSTRACT

A packer for anchoring and sealing to a tubular in a well, the packer including a packer element, an anchoring arrangement, a setting mechanism and a release mechanism. The release mechanism holds a thin-walled section of tubing in the packer in tension using a biasing mechanism. On severing the tubing, the bias releases an engagement mechanism which allows the anchor arrangement and the packing element to move relative to the body and thereby unset the packer. An embodiment of a dual bore packer is described. A method of well isolation is described, with an assembly including the dual bore packer. The primary bore forms the short string and a secondary bore forms the long string. By severing the short string the integrity of the long string is maintained to pull lower devices on the long string and the short string does not require tension below the packer to release.

20 Claims, 6 Drawing Sheets

(56) References Cited

U.S. PATENT DOCUMENTS

| | | | | |
|---|---|---|---|---|
| 4,413,677 | A | 11/1983 | Perkins | |
| 4,512,399 | A | 4/1985 | Gano et al. | |
| 4,582,134 | A * | 4/1986 | Gano | E21B 33/1295 166/120 |
| 4,913,228 | A * | 4/1990 | Setterberg, Jr. | E21B 33/122 166/134 |
| 5,273,109 | A | 12/1993 | Arizmendi | |
| 2003/0116328 | A1 | 6/2003 | Doane et al. | |
| 2009/0294119 | A1 | 12/2009 | Burnett et al. | |
| 2015/0252645 | A1 | 9/2015 | Hammer et al. | |
| 2016/0222755 | A1 | 8/2016 | Angman et al. | |

OTHER PUBLICATIONS

Intellectual Property Office of the UK Patent Office; Search Report for GB2017446.2, claims 17-25; one page; dated Apr. 13, 2021; Intellectual Property Office of the UK Patent Office, Newport, South Wales, United Kingdom.

* cited by examiner

PACKER AND METHOD OF ISOLATING PRODUCTION ZONES

The present invention relates to packers as used to provide isolation between hydrocarbon producing zones in subterranean oil wells and in particular, though not exclusively, to a hydraulically set dual bore packer having a cut to release retrieval mechanism.

In drilling and completing wells for hydrocarbon production packers are used to provide a pressure tight barrier in an annulus outside tubing to prevent hydrocarbons travelling up the annulus to surface. Where hydrocarbons are to be produced discretely from separate production zones, a multi-string production packer may be deployed. FIG. 1 illustrates the typical features of a dual string production packer assembly. Two parallel arranged strings, referred to as long string A and adjacent short string B are connected together via a packer C. Packer C comprises the standard components of an anchoring means D and a sealing means E, these may typically be toothed slips and an elastomeric packing element, respectively. A lower packer F is present which is only used to seal the long string A. With both packers C,F set, which may be by temporarily plugging I,J each string A,B, the long string A transports produced fluids from a production zone G located below the second packer F, while the short string B transports produced fluids from the production zone H located between the packers C,F with the packers providing pressure tight barriers between the production zones G,H and the production zone G and surface.

A feature of production packers is their need to be retrievable after what can be years of service within a well. There are a number of known retrieval methods for packers which include: pull to release, requiring shearing of securing pins or a shear ring allowing the slips and packing element to relax; shift to release, where a sleeve or supporting mechanism is moved using a shifting device to allow the slips and packing element to relax; mill to release, where a portion of the packer is milled allowing the packing element and slips to relax; and cut to release, where a load carrying member within the packer is cut either mechanically or chemically allowing the packing element and slips to release.

Pull to release and shift to release packers commonly include some shearing pins or shiftable device, typically whereby the setting loads are locked into the same pins or device and as such the maximum pressure the packer can withstand is typically limited by these pins or device. A disadvantage of this is that the packer is particularly weak when pressure from below is applied in combination with tension in the string above since pressure from below and tension typically act in unison, whereby the resulting upwards force can overcome the shear rating and prematurely release the packer.

Mill to release packers, also known as permanent packers are the most robust in industry as they contain no shearable, frangible or shiftable componentry, however the disadvantage to these is that significant effort is required to mill these packers to allow them to release.

Cut to release packers rely on there being tension in the string below the cut to operate the release. For the dual string packers, the short string has insufficient length providing insufficient weight to create the required tension for release occur, while for the long string the tensile force and movement required may not be sufficient since this tubing string is in turn secured firmly by the lower packer with many designs also having the long string held in compression between the packers. Additionally, any cut made in the long string will reduce the strength of the packer such that when attempting to retrieve the lower packer by applying tensile force through the packer, that the packer is not strong enough. A yet further disadvantage in cutting the long string is that well control is lost as kill fluid can no longer be circulated to lower parts of the well if a kick occurs.

U.S. Pat. No. 4,512,399 discloses a hydraulically set retrievable well packer using a cut to release system, with dual mandrels connectable into well tubing, for sealing the tubing to and anchoring the packer body in well casing utilizing a unique c-ring slip system. The mandrels are slidably connected for limited longitudinal movement in the packer body, which eliminates tubing spacing-out and temperature length change problems. There is a separate mandrel through the packer body for conducting flow from the casing annulus below the set packer. An internal lock system is provided to retain the packer in set position. If tubing parts above the set packer, the mandrels are supported and metal-to-metal sealed in the packer preventing tubing below the packer from falling. The packer may be retrieved by cutting one or both mandrels above the packing elements and picking up to release an internal connector which allows the slips and packing element to retract and the packer to be retrieved from the well. The anchoring, sealing and releasing means of this invention can be readily adapted for use on a single or multiple mandrel well packer.

This packer has the disadvantages described above in relation to cut to release packers as each cut requires there to be sufficient weight on the lower tubular string to release the packer. It further shows difficulties in providing seals around the two independent mandrels making the design complex and requires a third mandrel to bring the fluid to hydraulically operate the packer from surface.

It is therefore an object of the present invention to provide a cut to release packer which obviates or mitigates at least some of the disadvantages of prior art packers.

It is a further object of at least one embodiment of the present invention to provide a dual bore packer with a cut to release mechanism which obviates or mitigates at least some of the disadvantages of prior art packers.

It is a still further object of at least one embodiment of the present invention to provide a method of isolating production zones in a well which obviates or mitigates at least some of the disadvantages of the prior art.

According to a first aspect of the present invention there is provided a packer for anchoring and sealing to an inner wall of a tubular in a well, the packer comprising:

a substantially cylindrical body having a first bore therethrough, an upper connector at a first end of the first bore for connection to an upper mandrel of a primary string and a lower connector at a second end of the first bore for connection to a lower mandrel of the primary string, the primary string having a primary bore and the first bore being considered as a portion of the primary bore;

a packing element positioned around the body;

an anchoring arrangement positioned around the body;

a setting mechanism which causes the anchoring arrangement and the packing element to move relative to the body to engage and seal the packer to the inner wall of the tubular in the well;

a release mechanism which causes the anchoring arrangement and packing element to move relative to the body and disengage the packer from the tubular;

and characterised in that:

the release mechanism comprises:

a sleeve mounted around the body and extending over a portion of a thin-walled section of tubing bounding the primary bore to create an annular chamber between the sleeve and the thin walled section of tubing; the sleeve being connected to the body at an upper end by an engagement mechanism;

the engagement mechanism including biasing means to hold the portion of the thin-walled section of tubing in tension with respect to the sleeve;

wherein:

on severing of the thin-walled section of tubing, the biasing means acts to cause release of the tension and the engagement mechanism so as to move the sleeve, the anchor arrangement and the packing element relative to the body and thereby unset the packer.

In this way, by holding a portion of the primary string in tension within the packer, this removes the requirement for the string below the packer to be held in tension. Accordingly, sufficient weight no longer needs to be carried on the string below a cut to release packer and the packer therefore finds application in horizontal or highly deviated well bores where string tension below the packer is not available for its release.

The thin-walled section of tubing may be a portion of the body and the sleeve extends across a lower portion of the body. In this embodiment, the sleeve may be fixed to a lower end of the body. In this way, a single bore packer is provided with the connections to the upper and lower mandrels at opposing ends of the packer.

Alternatively, the thin-walled section of tubing may be a portion of the lower mandrel. In this embodiment, the sleeve extends from a lower end of the body over a portion of the lower mandrel and lower end of the sleeve may be fixed to the lower mandrel. In this way, the lower mandrel of the primary string may be held in tension within the packer. This also provides an arrangement in which the wall thickness of the body can remain substantially uniform across the packer.

Preferably, the engagement mechanism is a detent. In this way, on release of the tension, the biasing means moves the detent to disengage the sleeve from the body. Preferably, the detent comprises one or more locking dogs whose radial movement is prevented by a shroud which is moved on release of the tension. In this way, tensile force generated by pressure from below the packer can be held between the setting mechanism and the body though the engagement mechanism so that the thin-walled section of tubing can be appreciably thinner than on prior art cut to release packers as it does not have to hold such tensile force from below. This makes severing of the thin-walled section of tubing possible using cutting tools which are designed to cut standard tubing thicknesses.

Preferably, severing of the thin-walled section of tubing is performed by a cutting tool. Alternatively, the thin-walled section of tubing comprises upper and lower sections interlocked by a shifting sleeve and severing occurs by operating a shifting mechanism, deployed from surface, to release shift the sleeve. In this way, severing is considered as creating separation of an upper and lower section of tubing.

Preferably, the anchoring arrangement is a plurality of slips, the slips including a surface configured to grip the inner surface of the tubular. Preferably the packing element is an elastomeric ring whose diameter increases under compression. Preferably, the anchoring arrangement is located below the packing element and the release mechanism is located below the anchoring arrangement. In this way, the biasing means needs to hold less tension and the weight of the packing element and anchoring arrangement can assist in their release.

Preferably, the setting mechanism comprises at least one hydraulically actuated piston which by fluid entering a port causes the relative movement to compress the packer element and set the anchor arrangement. More preferably, the at least one piston moves an element over a ratchet to thereby lock the packer in the set configuration. Preferably the port is on an inner wall of the first bore. In this way, the packer can be set by pumping fluid from surface.

In an embodiment, the port is between the packer element and the anchoring arrangement. Thus oppositely directed pistons act on the packer element and the anchoring arrangement, the pistons being interlinked by the ratchet. In this way, the packer element and the anchoring arrangement can be set together as compared to prior art arrangements which require the anchoring arrangement to be set before the packer element.

Preferably, the release mechanism further comprises an anti-lock ring, the anti-lock ring having a ratchet so that the sleeve is prevented from moving upwards on the body following release. In this way, accidental reset of the packer is prevented.

In an embodiment, the substantially cylindrical body further includes a second bore therethrough, an upper connector at a first end of the second bore for connection to an upper mandrel of a secondary string and a lower connector at a second end of the second bore being connected to a lower mandrel of the secondary string and wherein the lower end of the sleeve is connected to the lower mandrel of the secondary string by a sliding seal, so that the sleeve can move relative to the lower mandrel of the secondary string. In this arrangement, the thin-walled section of tubing is provided by the lower mandrel of the primary string. In this way, a dual bore packer is formed. Advantageously, only the lower mandrel of the primary string needs to be severed to release the packer. In this way, the primary string can be the short string and the secondary string can be the long string. There may be a plurality of secondary strings to provide a multi-bore packer. Advantageously, as bores are created through a body of the packer, the configuration is less complicated over the multi-string packers of the prior art in which the mandrels extend through the packers.

Preferably, the secondary string includes a device on the lower mandrel. Preferably, the device is a further packer. In this way, a straddle packer is formed so that fluids can be produced from an upper production zone through the primary string, sometimes referred to as the short string, while fluids are produced from a lower production zone, through the secondary string or long string. The straddle packer provides zonal isolation between the production zones and surface. In this way, the cut can be performed on the short string without compromising the strength of the body allowing full tensile force to be transmitted to the lower packer when retrieving it. Further this arrangement allows the packer slips and element to be relaxed without the need for string tension below the packer and therefore allows release to be performed independently of any compressive or tensive forces in the long string.

According to a second aspect of the present invention there is provided a method of isolating production zones in a well comprising the steps:

(a) running a retrievable packer assembly into the well, the retrievable packer assembly comprising an upper hydraulically set packer with primary and secondary strings extending therefrom and a lower retrievable packer;

(b) locating a lower end of the secondary string at a lower production zone and a lower end of the primary string at an upper production zone;

(c) setting the lower packer to anchor and seal against an inner wall of a tubular in the well;

(d) setting the upper packer to anchor and seal against the inner wall of the tubular in the well;

(e) producing the well;

(f) running a tool and severing a tubular section in the upper packer to unset the upper packer;

(g) pulling the secondary string to unset the lower packer and retrieve the packer assembly;

characterised in that:

the upper packer is set by applying pressure to the primary string;

the lower packer is set by applying pressure to the secondary string; and the tool is run in the primary string and severs a tubular section of the primary string.

In this way, by severing the primary string, which is the short string, the integrity of the secondary string i.e. the long string is maintained so that it can be used to retrieve the lower packer. Additionally, on severing of the primary/short string, the resultant downward movement of the severed end of the primary string which needs to take place to unset the upper packer, can occur as there is space below the upper packer in the upper production zone. This is in contrast to prior art cut to release packers using the secondary string wherein as the secondary string is fixed to a lower packer below the upper packer there may be insufficient tensile force and movement which can occur to release the upper packer.

Preferably, the upper packer is according to the first aspect including a primary and a secondary string. In this way, the primary string does not require to have sufficient weight on the portion of the string below the upper packer to unset the upper packer.

Preferably, the tool is a cutting tool and the primary string is severed by cutting through a thin-walled section of tubing. Alternatively, the tool is a shifting tool and the primary string is severed by releasing an interlocking sleeve between separate upper and lower portions of the primary string.

Preferably, at step (d) the upper packer is locked in the set position.

Preferably, pressure is increased in the primary bore by pumping from surface. More preferably, the pressure is increased in the primary bore by temporarily blocking the primary bore at a lower end thereof. This can be done by use of a drop ball falling to an expandable seat in the primary bore or an extrudable ball falling to a ball seat in the primary bore. Preferably, increased fluid pressure enters a port on the inner wall of the primary bore between a packer element and an anchoring arrangement to hydraulically actuate opposing pistons to set the upper packer.

Preferably, at step (f) on severing the tubular section an anti-return mechanism is activated so as to prevent reverse movement of the severed section with respect to upper packer. In this way, accidental re-setting of the upper packer is avoided.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different features and teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof. While the description refers to "upper" and "lower", "top" and "bottom", these terms are considered as relative, referring to "uphole" and "downhole" in a well, and thus equally apply to vertical, deviated and horizontal wells.

Embodiments of the present invention will now be described with reference to the following figures, by way of example only, in which.

Figure 5A:
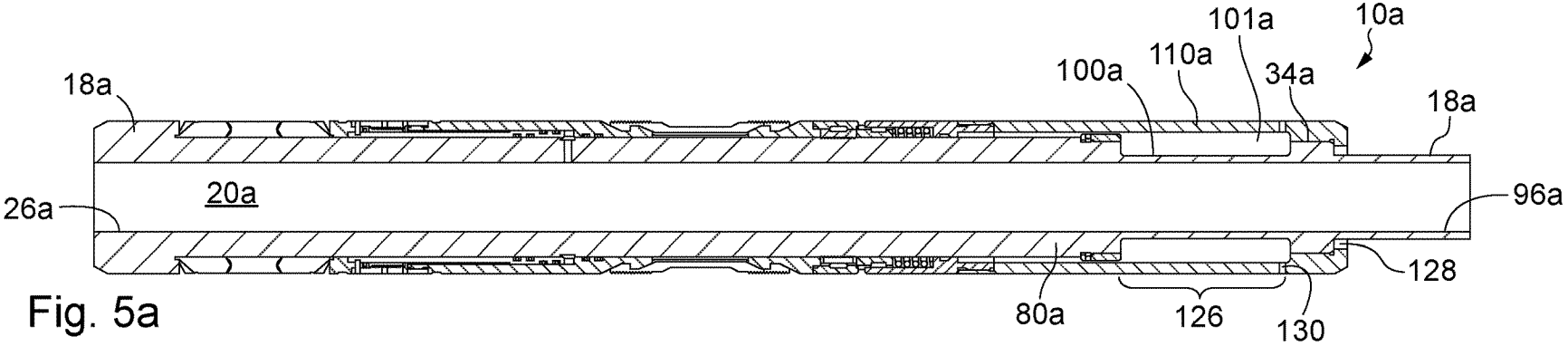
Figure 5B:
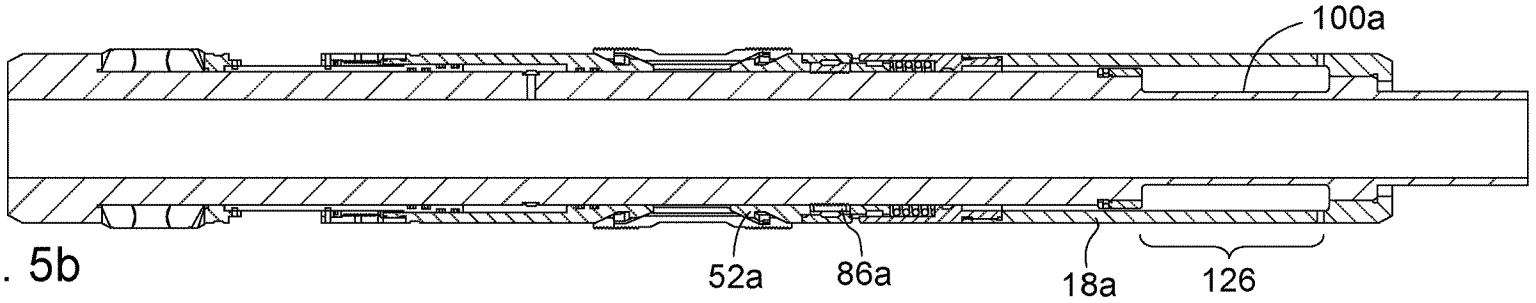
Figure 5C:
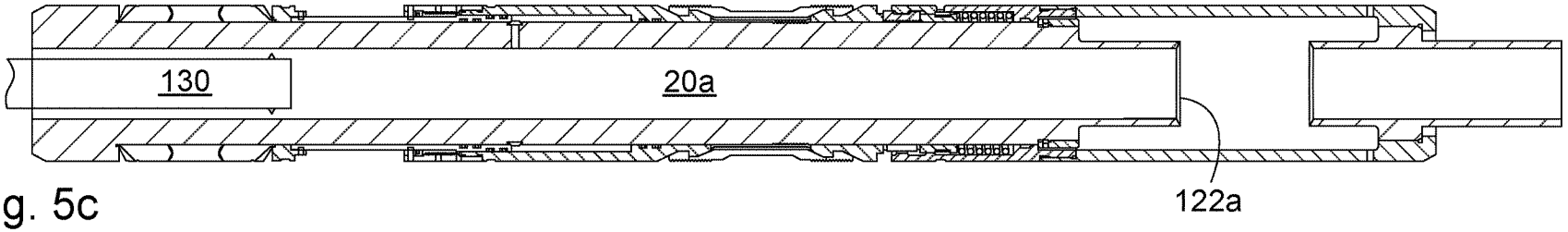
Figure 6A:
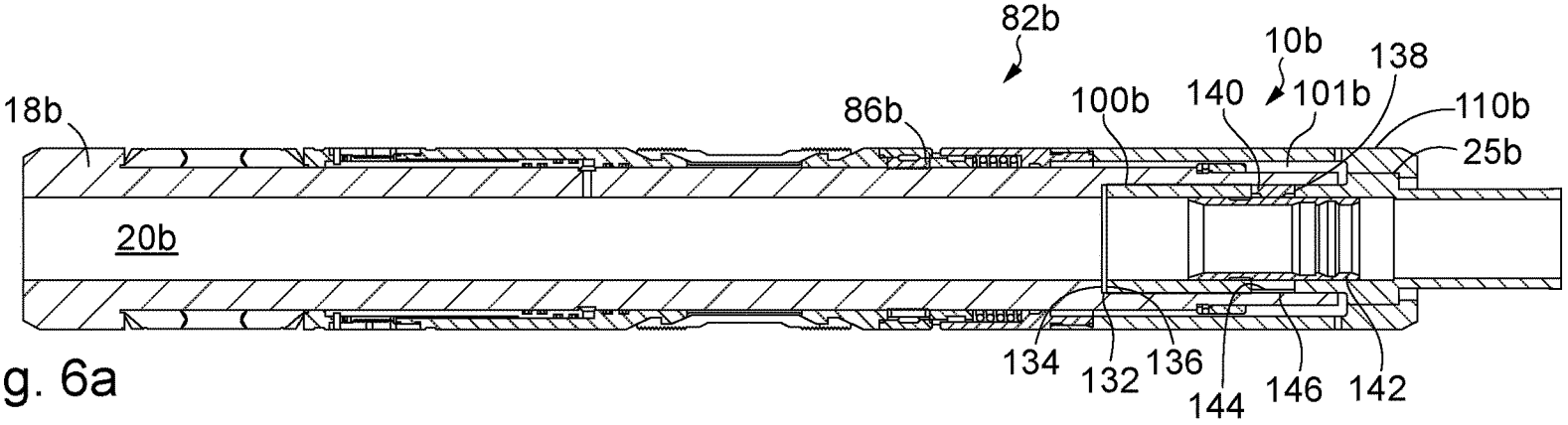
Figure 6B:
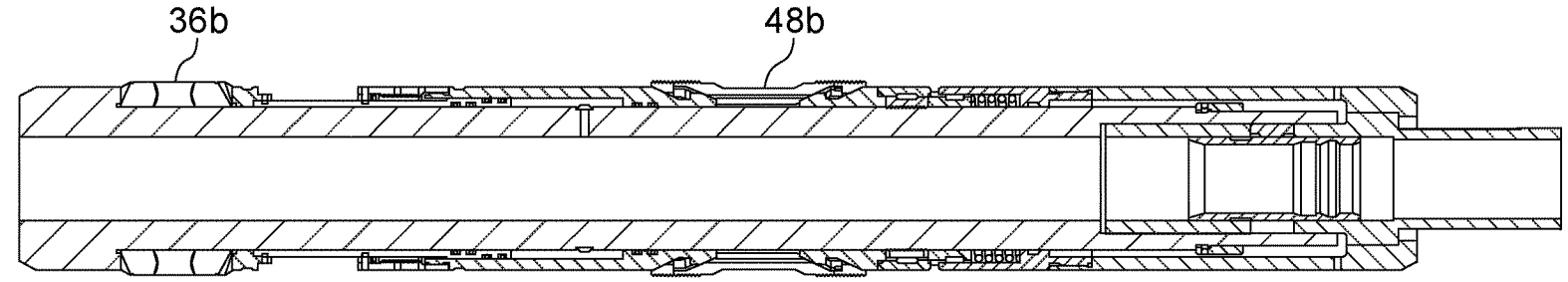
Figure 6C:
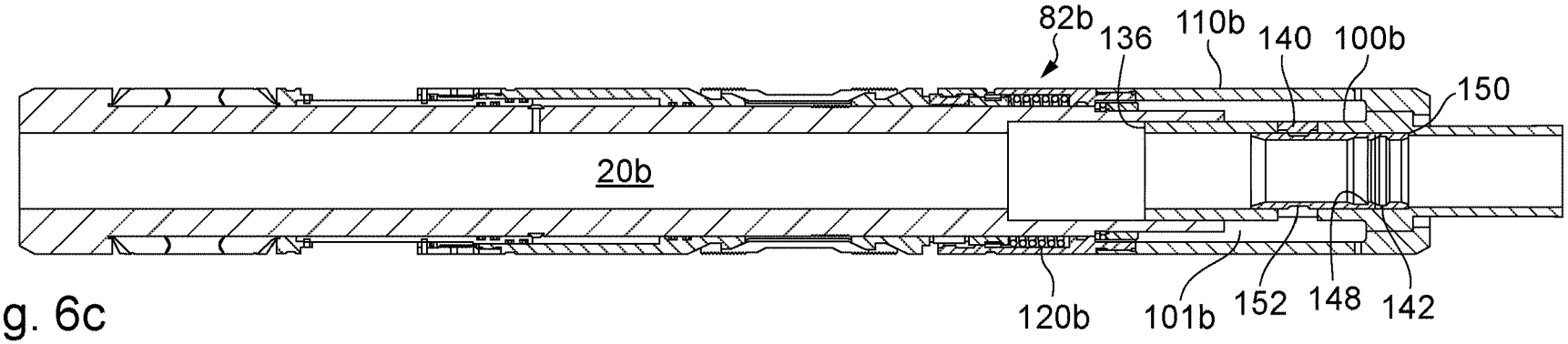

FIGS. 5(*a*) to 5(*c*) are cross-sectional views through a single bore packer in (a) unset (b) set and (c) released configurations according to an embodiment of the present invention; and FIGS. 6(*a*) to 6(*c*) are cross-sectional views through a single bore packer in (a) unset (b) set and (c) released configurations according to a further embodiment of the present invention.

Figure 2:
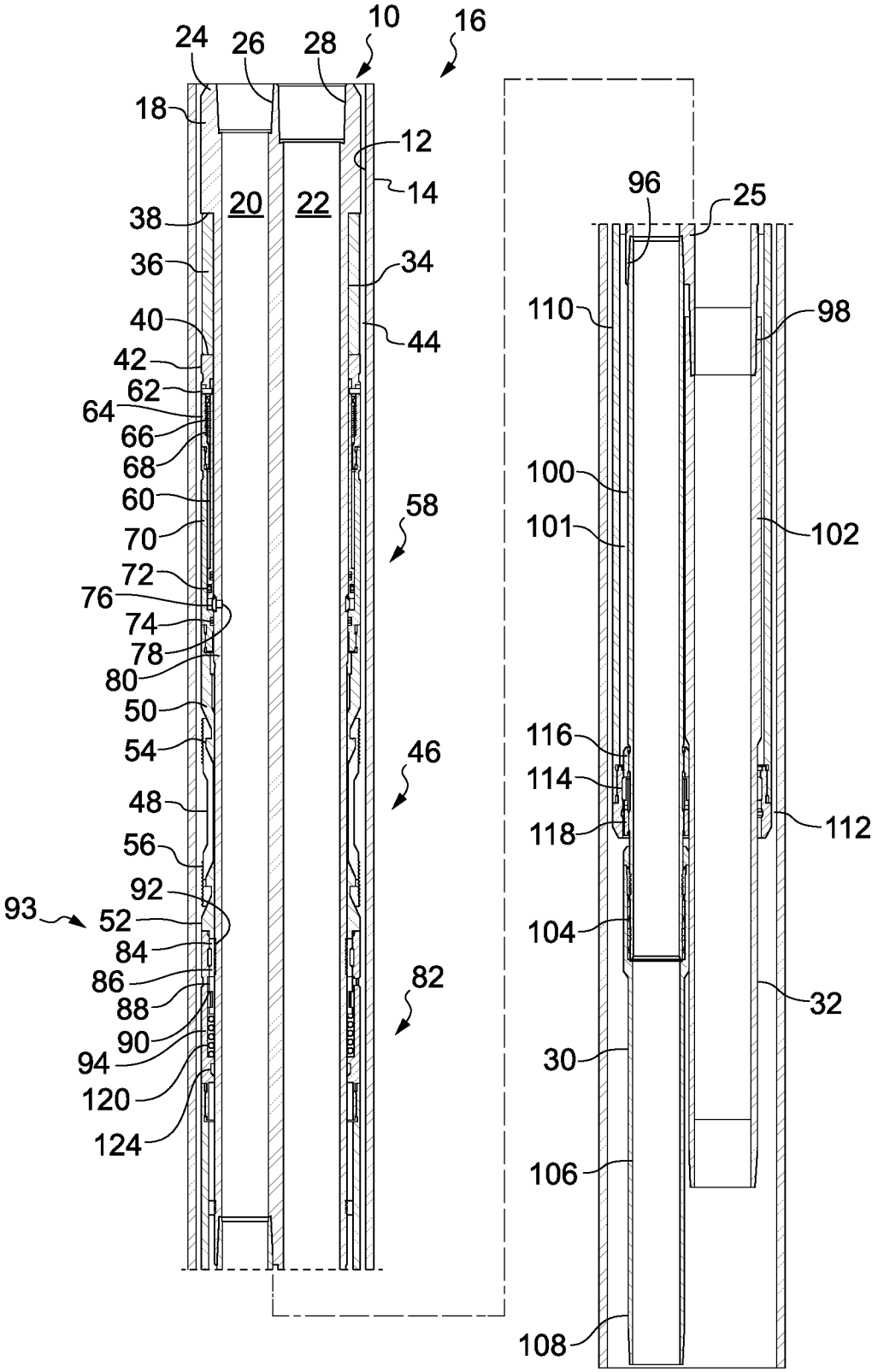
FIG. 2 is a cross-sectional view through a dual bore packer shown in a run-in configuration according to an embodiment of the present invention.

Reference is initially made to FIG. 2 of the drawings which illustrates a dual bore packer, generally indicated by reference numeral 10, for anchoring and sealing to an inner wall 12 of a tubular 14, in a well 16 according to an embodiment of the present invention. The tubular 14 is typically a liner or casing in the well 16.

Packer 10 comprises a substantially cylindrical body 18 through which is arranged two parallel bores, a first or primary bore 20 and a second or secondary bore 22. While the primary bore 20 is shown as narrower in diameter to the secondary bore 22, this need not be the case and the bores 20, 22 can be of any diameters. At an upper end 24 of the body 18, each bore 20, 22 includes a threaded connection, 26, 28 respectively, for connection to upper mandrels of a primary string 30 and secondary string 32 as shown as B and A, respectively, from packer C in FIG. 1. Primary string 30 may be referred to as a short string while secondary string 32 may be referred to as a long string. For clarity it is generally understood, unless stated otherwise, that the packer 10 components are constructed of steel or similar high strength metallurgy. The components are arranged to slide along the outer surface 34 of the body 18.

About the body 18 is installed a rubber packer element 36, as is known in the art, which is abutted between two shoulders 38, 40. Upper shoulder 38 is formed on the outer surface 34 of the body 18 and lower shoulder 40 is provided by a gauge ring 42 moveable along the outer surface 34. As will be described later, the rubber packer element 36 can be energized by compression between the two shoulders 38, 40 to provide a seal across the annulus 44 between the packer and the tubular 14.

Further down the body 18 is positioned an anchor arrangement 46 used to selectively anchor the packer 10 to the inner wall 12. The anchor arrangement comprises a set of barrel slips 48 sitting around the body 18 on an upper cone 50 and a lower cone 52 at opposite ends thereof. The barrel slips 48 interface with the upper cone 50 and lower cone 52 on a series of conical ramps 54, such that with the lower cone 52 fixed in position when the upper cone 50 moves downwards, the barrel slips 48 expand under high force allowing slip teeth 56 on their outer surface to engage the inner wall 12. The barrel slips 48 feature longitudinal slits (not shown) to allow expansion and contraction when desired. It will be recognised that other slip designs and expansion arrangements can be used.

Between the packer element 36 and the anchor arrangement 46 there is provided a setting mechanism 58. An internal profile within the gauge ring 42 abuts against a nose profile on a cylinder considered as a piston 60. Movement of the piston 60 is temporarily restricted by shear pins 62 fitted through holes drilled thorough the piston 60, gauge ring 42 and a lock ring housing 64. The shear pins 62 will shear in a controlled manner when sufficient hydraulic pressure is applied to the piston 60.

The lock ring housing 64 is installed over the piston 60 and between the two is installed a segmented lock ring 66 having a ratcheting threaded profile 68 which is biased to allow relative movement of the piston 60 upwards relative to the lock ring housing 64 but prevents movement in the opposite direction, functioning as a ratchet locking device. The lock ring housing 64 is threaded to a cylinder 70, considered as a second piston, which is in turn threaded to the upper cone 50. O-rings 72, 74 fitted to the piston 60 and cylinder 70 form a pressure vessel 76 which, when pressurised fluid enters the vessel, drives the piston 60 upwards and the cylinder 70 downwards when desired. The relative movements of the piston 60 and cylinder 70 are locked by the segmented lock ring 66. This forms the setting function of the packer 10. Access of pressurised fluid to the vessel 76 is through a port 78, or drilled ports, through the wall 80 of the body 18 in the first or primary bore 20. A preferred embodiment has drilled ports 78 connecting the short string bore 20 and cylinder 70/piston 60—although this could also be achieved by drilling similar ports into the long string bore 22.

Below the anchoring arrangement 46 and formed integrally with it is a release mechanism 82. The lower cone 52 features a series of milled windows 84 into which dogs 86 are installed and a snap ring groove 88 into which a snap ring 90 is installed. Dogs 86 have a toothed profile 92 on a surface which engages the outer surface 34 of the body 18. A release housing 94 is located over the dogs 86 and keeps them in position against the body 18. This arrangement, which may be considered as an engagement mechanism 93, also holds the lower cone 52 in position for run in and setting of the packer 10. The dogs 86 and the body 18, through the toothed profile 92 will take the full setting weight and any loads such that when the dogs 86 are fully located and the release housing 94 is installed over and retaining them, the lower cone 52 is fixed axially to the body 18 during the setting sequence and until so desired to release the packer 10.

Figure 1:
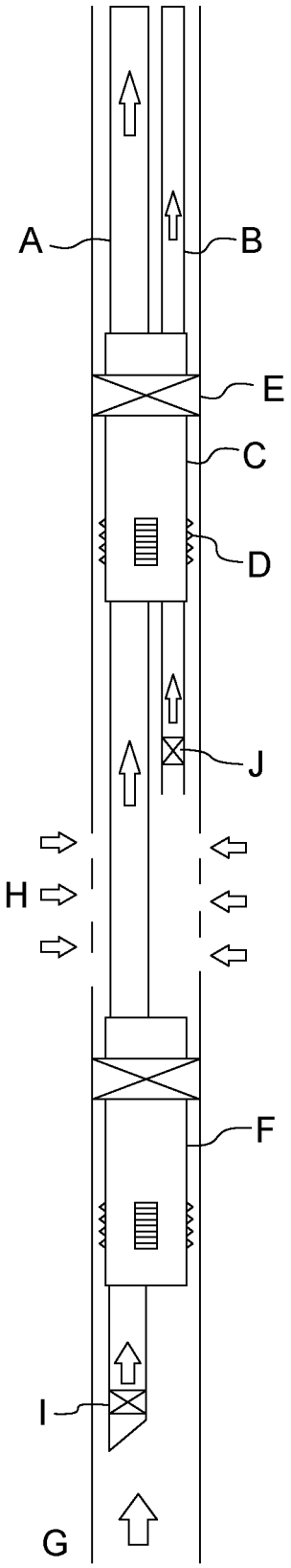
Fig. 1 PRIOR ART
FIG. 1 is a schematic illustration of a packer assembly used for isolating production zones in a well bore according to the prior art.

In the embodiment shown in FIG. 2, the lower end 25 of the body 18 has threaded connectors 96, 98 at the ends of the primary and secondary bores 20, 22 respectively. These provide connection for lower mandrels 100, 102 of the primary string 30 and secondary string 32, respectively. Only a first section of a mandrel 102 is shown on the secondary string 32 though it will be appreciated that this is the long string and will thus have further mandrel sections to connect the secondary string 32 to a lower packer F or other device as illustrated in FIG. 1. The first section of the mandrel 100 on the primary string 30 can be considered as a cut tube. The cut tube 100 is a thin-walled section of tubing, with a wall thickness less than that of the body 18. In the embodiment shown in FIG. 2, the cut tube 100 has a swivel device 104 connected at a base for further mandrel sections to be attached thereto. The further mandrel sections will form the extension 106 to the short string B. The swivel device 104 is as known in the art and consists of a soft bearing material and seals such that the short string extension 106 can rotate and shall form a pressure tight extension from the packer 10 when installed in the well 16. The swivel device 104 allows make-up of the short string pin thread 108 to the short string without rotating the entire packer 10 after the long string has been made up to the long string pin thread 98 during installation.

The release mechanism 82 further comprises a sleeve 110 arranged around the body 18 which at one end is connected to the release housing 94 and at its opposite end is connected to an end ring 112. The sleeve 110 extends beyond the lower end of the body 18 and over a portion of the further mandrels 100, 102. This creates an annular chamber 101 between the sleeve 110 and further mandrels 100, 102. The end ring 112 is connected to a base plate 114 which is in turn clamped to the cut tube 100 by means of an interlocking mechanism formed by a retainer ring 116 and a lock ring 118. The end ring 112 and base plate 114 form a sliding seal with the further mandrel 102 of the secondary string 32 (long string) so that the sleeve 110 can move relative to the further mandrel 102. As the cut tube 100 is threaded 96 to the lower end of the body 18 forming a continuation of the short string or primary bore 20, when assembled the result is that the cut tube 100 secures the release housing 94 which shrouds the dogs 86 allowing the packer 10 to retain the setting load required for it to function. A compression spring 120 is installed as a biasing mechanism between the lower cone 52 and the release housing 94 such that through the interlocking of components a tensile force is applied to the cut tube 100. Furthermore an anti-reset ring 124 is installed inside the release housing 94 which includes another ratcheting mechanism to allow the release housing 94 to slide downwards along the body 18 and preventing it returning, a function useful after the packer 10 has been released.

The packer 10 is shown in the run-in configuration in FIG. 2 with the packer element 36 relaxed and the slips 48 of the anchor arrangement 46 un-set and held against the body 18 away from the inner wall 12 of the tubular 14. The cut tube 100 is held in tension.

In a method of isolating production zones G,H in a well 16, the dual bore packer 10 can form part of an assembly as shown in FIG. 1. Packer 10 is in place of packer C, the primary string is B, the secondary string is A, and the lower packer F is also a retrievable packer.

The assembly is run into a well with both packers 10, F in un-set configurations. Packer 10 is as shown in FIG. 2. A lower end of the secondary (long) string 32,A is located at a lower production zone G while the lower end of the primary (short) string 30,B is located at an upper production zone H. The lower packer F is set by known means, such as by increasing fluid pressure in the secondary (long) string 32. Those skilled in the art will recognise that a ball seat and drop ball can be used to temporarily block a bore 20, 22 to increase fluid pressure above the seat. The seat may be expandable or the ball may be extrudable to release and unblock the bore when a fixed pressure is arrived at. Other means exist such as setting of a temporary plug I,J as shown in FIG. 1.

The packer 10 is set by increasing fluid pressure in the primary (short) string 30. Hydrostatic pressure is applied at surface through the primary bore 20. The fluid at pressure passes through the ports 78 and enters the vessel 76. This drives the piston 60 and cylinder 70 apart. The shear pins 62 restrict this movement until the resulting piston force exceeds the shear rating, shearing the pins 62 and driving the piston 60 upwards and the cylinder 70 downwards. The piston 60 acts on the gauge ring 42 which compresses the packer element 36 between the shoulders 38, 40. The packer element 36 elastically expands until it touches the inner wall 12 of the tubular 14. Continued applied force allows the packer element 36 to form a pressure tight seal across the annulus 44.

Simultaneously the cylinder 70 acts on the upper cone 50 moving it downwards, resulting in the ramps 54 passing over each other as the cones 50, 52 slide under the barrel slip 48. The barrel slip 48 is moved radially outwards so that the teeth 56 bite the inner wall 12 forming a robust and rigid anchoring mechanism. The segmented lock ring 66 retains this setting force due to its ratcheting mechanism 68. The well operator will continue applying pressure up to a predetermined value (for example 3,000 lbs/sq. inch) and will then perform a pressure test to confirm the packer 10 is set.

Figure 3:
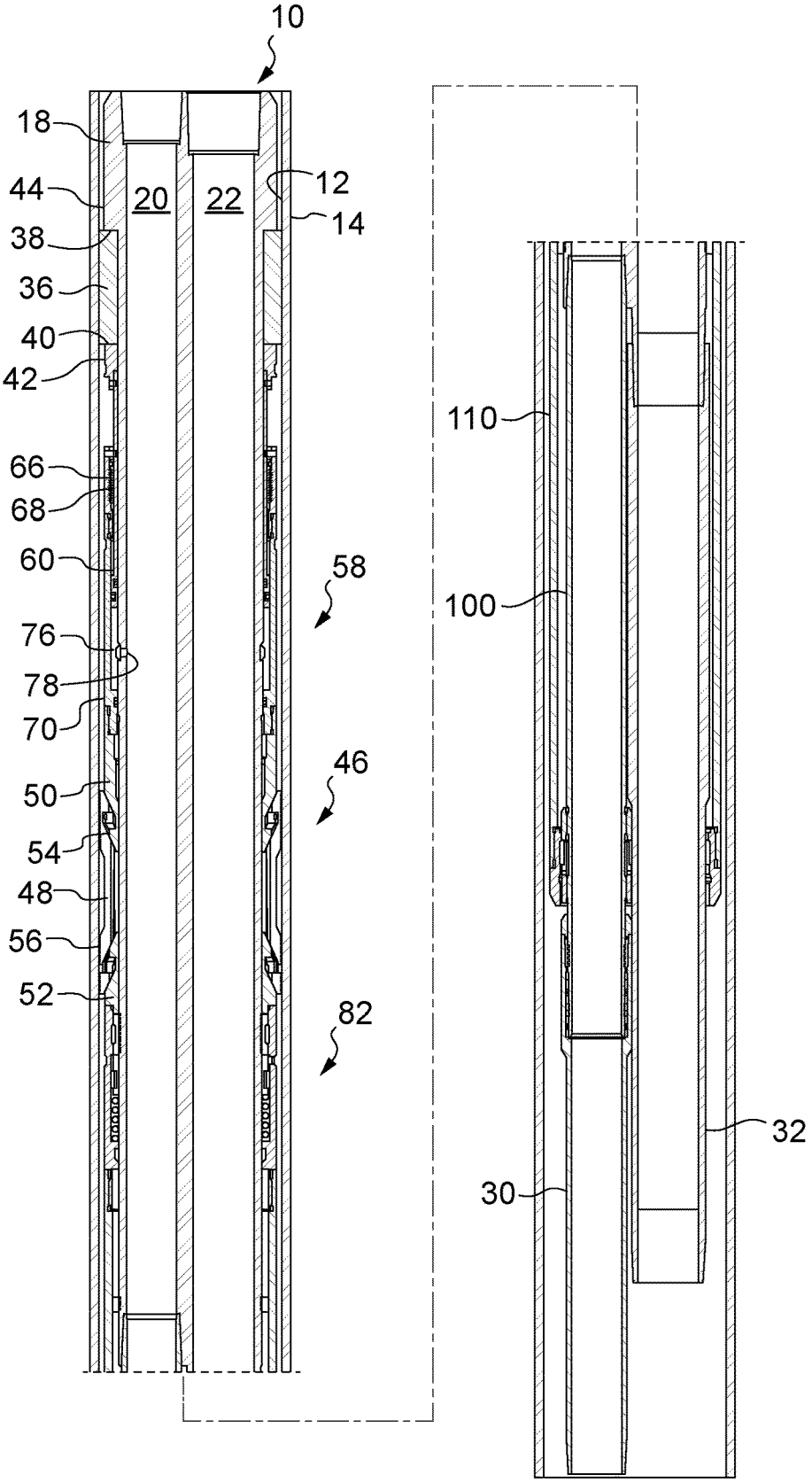
FIG. 3 is a cross-sectional view through the packer of FIG. 2 shown in a set configuration.

This set configuration is illustrated in FIG. 3, with like parts being given the same reference numeral to aid clarity.

It will be noted that the lower cone 52 does not move and thus the release mechanism 82 plays no part in the setting of the packer 10. As the dogs 86 are anchored to the body 18, this takes the tensile force from pressure from below. The tension on the cut tube 100 remains unchanged.

Once set other well operations may commence until the well is ready to produce hydrocarbons. Fluids from the production zones G,H can be separately transported to surface in the distinct primary (short) and secondary (long) strings 30, 32. The strings 30, 32 could also be used to introduce water of other chemicals to the production zones G,H. At some time in the future, perhaps several years, it will be desirable to retrieve the packer 10 and this sequence will be described further and illustrated in FIG. 4. Like parts to those of FIG. 2 have been given the same reference numeral to aid clarity.

A cutting device (not shown) is lowered into the primary bore 20 and located to place the cutting device across the cut tube 100 and a radial cut 122 is performed slicing through the cut tube 100 releasing the tensile force on it. The annular chamber 101 provides space so that the sleeve 110 is not severed. Once the tensile force is released the compression spring 120 pushes the release housing 94 downwards along with the associated sleeve 110, end ring 112, base plate 114, retainer ring 116, lock ring 118 and the severed portion of the cut tube 100. Note mandrel 102 of the secondary (long) string 32 does not move.

The release housing 94 movement also partially de-shrouds the dogs 86 allowing them to move radially outwards disengaging the toothed profile 92 from the outer surface 34 of the body 18. In order to de-shroud the dogs 86 in a controlled manner and prevent them dropping off the packer 10, the movement of the release housing 94 relative to the lower cone 52 is limited by the snap ring 90 provided by abutment of a shoulder. The engagement mechanism 93 is thus released.

With the dogs 86 disengaged and cut tube 100 severed, the external components on the body 18 are free to move downwards, releasing the setting load from the barrel slips 48 and packer element 36. The movement is driven by the stored energy in the packer 10 from the setting load, but can be assisted by gravity and upwards movement of the body 18. The release housing 94 will slide downwards until it abuts against a pickup ring 125 which is secured to the body 18 preventing any further axial movement. The anti-reset ring 124 located within the release housing 94 ratchets down a biasing profile on the outer surface 34 of the body 18 which prevents the same riding back up the body 18. This prevents accidental reset of the packer 10 during retrieval.

With the packer 10 released it is now possible to apply full pulling force to release the lower packer F as shown in FIG. 1 and both packers A,F can be retrieved simultaneously saving time. The full pulling force can be applied since the integrity of the secondary string (long) 32 has been maintained throughout as it was the primary string (short) 30 which was been severed to release the packer 10.

Additionally, by maintaining the integrity of the secondary string (long) 32, well control is also maintained throughout the procedure. If during retrieval of the system an influx of gas or oil into the well occurs (a kick), it is industry practice to 'kill the well' by pumping high density brine down the tubing which will re-establish hydrostatic control of the well and simultaneously circulating the 'kick' in a highly controlled fashion. Best practice is to place the tubing end at the deepest point in the well ideally close to the source of the kick. In the prior art case where the long string is cut at the upper packer this would open a circulation path well above this point. In the embodiment of present invention shown in FIGS. 2 to 4, there is no cut to the long string and the well can be circulated safely at the deepest point available.

It will be recognised by those skilled in the art that the release mechanism 82 can be adapted for use on a single bore packer. Such a single bore packer is illustrated in FIGS. 5(*a*)-(*c*). Like parts to those of FIGS. 2 to 4 have been given the same reference numeral but are now suffixed 'a'.

Packer 10*a* has a body 18*a* with a single axial throughbore 20*a*. In contrast to the embodiment of packer 10*a*, the body 18*a* now extends beyond the sleeve 110*a* at the lower end 25*a* while still providing the threaded connections 26*a*, 96*a* for connection of upper and lower mandrels of a tubular string (not shown). The wall 80*a* has been thinned over a portion 126 towards the lower end 25*a* to provide a thin-walled section of tubing 100*a* equivalent to the cut tube 100 of packer 10. The lower end 25*a* of the body has also be thinned. The diameter of the bore 20*a* has been maintained throughout so that the thinning has been completed by removing material from the outer surface 34*a* of the body 18*a*.

The sleeve 110*a* extends around a shoulder 128 towards the end of the body 18*a* and is attached thereto. This removes the requirement for the end ring 112, base plate 114, retainer ring 116 and locking ring 118 of packer 10. As the sleeve 110 is now attached around a shoulder 128 of the body, a port or ports 130 are provided to the annular chamber 101*a* which is created between the thinned portion 126 and the sleeve 110*a*.

Figure 4:
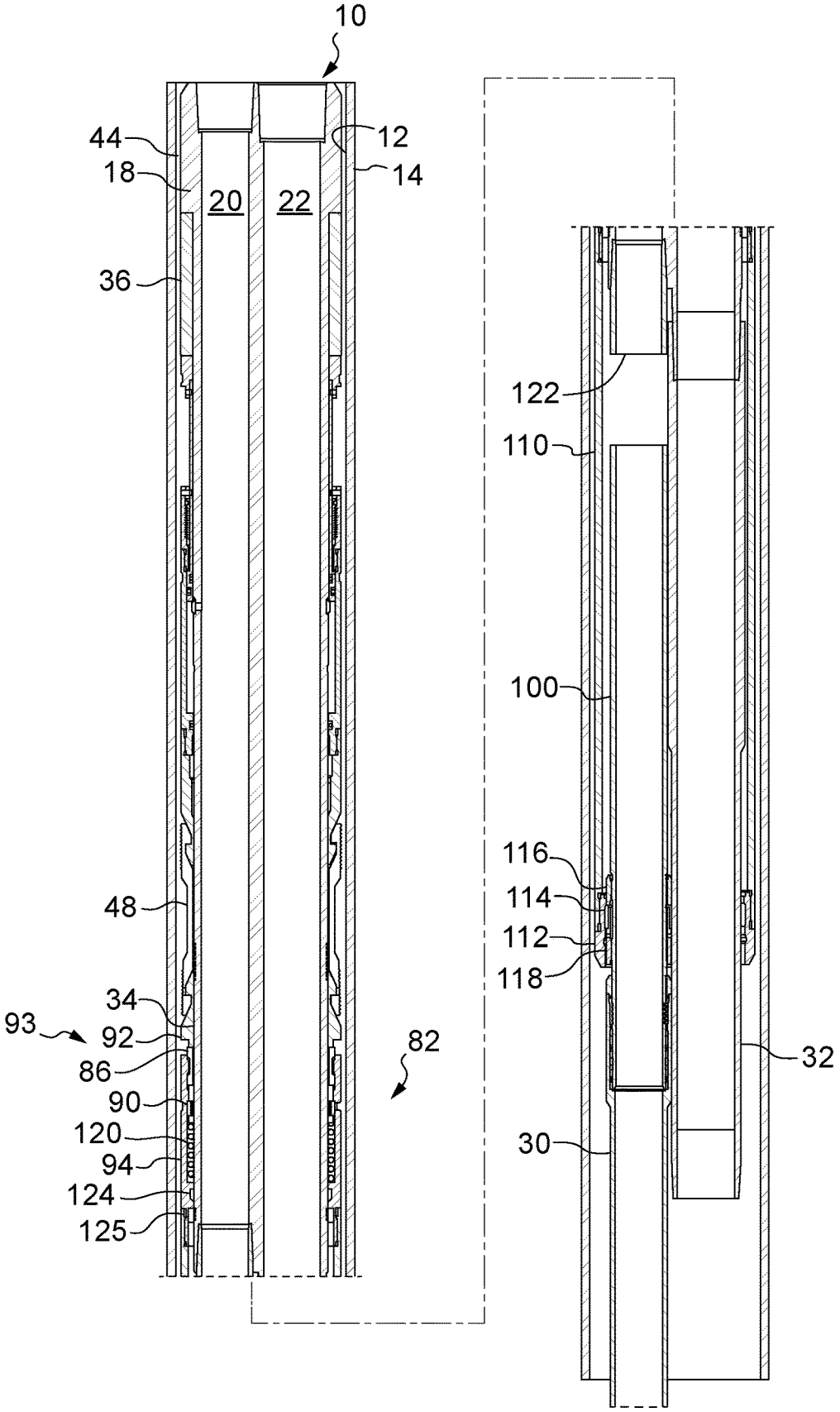
FIG. 4 is a cross-sectional view through the packer of FIG. 2 shown in a released configuration.

The packer 10*a* is set and released as described hereinbefore with reference to FIGS. 3 and 4.

An advantage in the packer 10*a* over prior art cut to release packers is in the ability for the thinned portion 126 to be as thin as a standard tubular wall thickness. FIG. 5(*a*) shows that the thinned portion 126 is of the same thickness as the lower end 25*a* of the body 18*a* with the connector 96. The lower end 25*a* is sized to match standard production tubing. In the prior art the portion 126 to be cut is appreciably thicker because as well as holding pressure the portion 126 also has to hold tensile force generated by pressure from below which manifests itself as a tensile force transmitted through the portion 126 requiring additional wall thickness. In the packer 10*a*, this force is locked between the lower cone 52*a* and body 18*a* through the dogs 86*a*, meaning the tube 100*a* at the portion 126 can be much thinner. It is also the case that specialist cutting tools are typically designed to cut standard tubing thicknesses, thus by being able to size the thickness of the wall at the portion 126 to be of standard tubing thickness, a specialist cutting tools is not required. The cut 122*a* is thus made using a standard cutting tool 130 run in the bore 20*a*.

Reference is now made to FIGS. 6(*a*) to 6(*c*) which illustrates a single bore packer, generally indicated by reference numeral 10*b*, according to a further embodiment of the present invention. Like parts to those of FIGS. 2 to 5 have been given the same reference numeral but are now suffixed 'b'.

In this embodiment, the thin-walled section or cut tube 100*b* is separate from the body 18*b* and held together during deployment of the packer 10*b*. In this regard it is severed by pulling the tube 100*b* and body 18*b* apart at the abutment position 132. A shoulder 134 on the body 18*b* in the primary bore 20*b* is used to rest an end 136 of the tube 100*b* upon. The cut tube 100*b* may be considered as a release sleeve and provides a connection to the lower mandrel or may be formed as part thereof. The tube 100*b* is threaded to the sleeve 110*b* at the lower end 25*b* of the body 18*b*. The tube 100*b* has a series of milled slots providing pockets 138 arranged circumferentially around the body of tube 100*b*, with each pocket 138 including a dog 140.

A shifting sleeve 142 is located in the primary bore 20*b* which covers and supports the dogs 140. In this un-set position, run-in, position shown in FIG. 6(*a*), the dogs 140 protrude from the pockets 138 and feature a mate-able external toothed profile 144 which engages with a toothed profile 146 on the body 18*b* at the annular chamber 101*b*. Accordingly, the tube 100*b* is locked to the body 18*b* which is in turn locked to the sleeve 110*b* via the dogs 86*b* in the release mechanism 82*b*. As the sleeve 110*b* is threaded to the tube 100*b*, the tube 100*b* is held in tension.

The packer is set as described hereinbefore with reference to FIG. 3, with the packer element 36*b* expanding and the slips 48*b* moving radially outwards. This is illustrated in FIG. 6(*b*).

To release the packer 10*b*, the shifting sleeve 142 is shunted downwards using a common shifting tool (not shown) which engages in the internal profile 148 until it hits an abutment 150 in the tube 100*b*, de-supporting the dogs 140 which each drop into a recess 152 on the shifting sleeve 142. This releases the shifting sleeve 142 from the body 18*b* so that it can move downwards by the bias of the spring 120*b* taking the sleeve 110*b* with it and activating the release mechanism 82*b* as described hereinbefore with reference to FIG. 4. This is as illustrated in FIG. 6(*c*).

It will be apparent to those skilled in the art that, although not shown, suitable o-rings and shear screws will be used to create seals between components and to temporarily hold components together until they need to operate i.e. the shifting sleeve 142. An additional feature of the packer 10*b*, is in the body 18*a* extending into the annular chamber 101*b*. This provides an overlap with the tube 100*b* for the dogs 140 to engage with without decreasing the diameter of the primary bore 20*b*. When the packer 10*b* is released, the tube 100*b* is severed from the body 18*a* at the abutment position 132 and travels downwards relative to the body 18*a*. The length of the tube 100*b* from the dogs 140 to the end 136 can be sized such that the primary bore 20*b* remains sealed even when the packer 10*b* is released.

The principle advantage of the present invention is that it provides a packer which can be released to allow the packer element and anchor arrangement to relax and unset by severing a portion of a tubular without requiring string tension below the packer. It is also considerably shorter as the cut tube has been removed.

A further advantage of an embodiment of the present invention is that it provides a dual bore packer for use in an assembly in which the packer can be released to allow the packer element and anchor arrangement to relax and unset by severing a short string and therefore allowing release to be performed independently of any compressive or tensive forces in the long string.

A yet further advantage of an embodiment of the present invention is that it provides a dual bore packer for use in an assembly which allows the short string to be severed without compromising the strength of the body of dual bore packer so that full tensile force can be transmitted to act on a lower device on the long string.

A still further advantage of an embodiment of the present invention is that it provides a dual bore packer for use in an assembly which allows the short string to be severed without compromising the strength of the body of dual bore packer so the circulation can be made through the long string to kill the well in the event of a kick.

It will be appreciated to those skilled in the art that various modifications may be made to the invention herein described without departing from the scope thereof. For example, the lower packer could have differing retrieval methods, or in fact may be another type of oilfield production device. There may in turn be multiple packers below the claimed packer, or above. The packer may have three or more bores. Furthermore, while the method describes a scenario of production from a hydrocarbon reservoir, the method can be used for injection purposes in through either of the short or long strings.

The invention claimed is:

1. A packer for anchoring and sealing to an inner wall of a tubular in a well, the packer comprising:

a substantially cylindrical body having a first bore therethrough, an upper connector at a first end of the first bore for connection to an upper mandrel of a primary string and a lower connector at a second end of the first bore for connection to a lower mandrel of the primary string, the primary string having a primary bore and the first bore being considered as a portion of the primary bore;

a packing element positioned around the body;

an anchoring arrangement positioned around the body;

a setting mechanism which causes the anchoring arrangement and the packing element to move relative to the body to engage and seal the packer to the inner wall of the tubular in the well;

a release mechanism which causes the anchoring arrangement and packing element to move relative to the body and disengage the packer from the tubular;

and characterised in that:

the release mechanism comprises:

a sleeve mounted around the body and extending over a portion of a thin-walled section of tubing bounding the primary bore to create an annular chamber between the sleeve and the thin walled section of tubing; the sleeve being connected to the body at an upper end by an engagement mechanism;

the engagement mechanism including biasing means to hold the portion of the thin-walled section of tubing in tension with respect to the sleeve;

wherein:

on severing of the thin-walled section of tubing, the biasing means acts to cause release of the tension and the engagement mechanism so as to move the sleeve, the anchor arrangement and the packing element relative to the body and thereby unset the packer.

2. A packer according to claim 1 wherein the thin-walled section of tubing is a portion of the body, the sleeve extends across a lower portion of the body and the sleeve is fixed to a lower end of the body.

3. A packer according to claim 1 wherein the thin-walled section of tubing is a portion of the lower mandrel, the sleeve extends from a lower end of the body over a portion of the lower mandrel and a lower end of the sleeve is fixed to the lower mandrel.

4. A packer according to claim 3 wherein the substantially cylindrical body further includes a second bore therethrough, an upper connector at a first end of the second bore for connection to an upper mandrel of a secondary string and a lower connector at a second end of the second bore being connected to a lower mandrel of the secondary string and wherein the lower end of the sleeve is connected to the lower mandrel of the secondary string by a sliding seal, so that the sleeve can move relative to the lower mandrel of the secondary string.

5. A packer according to claim 4 wherein the primary string is a short string and the secondary string is a long string, so that only the primary string is severed to release the packer.

6. A packer according to claim 4 wherein the secondary string includes a device on the lower mandrel.

7. A packer according to claim 6 wherein the device is a further packer.

8. A packer according to claim 1 wherein the engagement mechanism is a detent comprising one or more dogs whose radial movement is prevented by a shroud which is moved on release of the tension.

9. A packer according to claim 1 wherein severing of the thin-walled section of tubing is performed by a cutting tool cutting through the section.

10. A packer according to claim 1 wherein the thin-walled section of tubing comprises upper and lower sections interlocked by a shifting sleeve and severing occurs by operating a shifting mechanism, deployed from surface, to release shift the shifting sleeve.

11. A packer according to claim 1 wherein the anchoring arrangement is a plurality of slips, the slips including a surface configured to grip the inner surface of the tubular and the packing element is an elastomeric ring whose diameter increases under compression.

12. A packer according to claim 1 wherein the anchoring arrangement is located below the packing element and the release mechanism is located below the anchoring arrangement.

13. A packer according to claim 1 wherein the setting mechanism comprises at least one hydraulically actuated piston which by fluid entering a port causes the relative movement to compress the packer element and set the anchor arrangement.

14. A packer according to claim 13 wherein the at least one piston moves an element over a ratchet to thereby lock the packer in the set configuration.

15. A packer according to claim 13 wherein the port is on an inner wall of the first bore located between the packer element and the anchoring arrangement.

16. A packer according to claim 1 wherein the release mechanism further comprises an anti-lock ring, the anti-lock ring having a ratchet so that the sleeve is prevented from moving upwards on the body following release.

17. A method of isolating production zones in a well comprising the steps:

(a) running a retrievable packer assembly into the well, the retrievable packer assembly comprising an upper hydraulically set packer with primary and secondary strings extending therefrom and a lower retrievable packer;

(b) locating a lower end of the secondary string at a lower production zone and a lower end of the primary string at an upper production zone;

(c) setting the lower packer to anchor and seal against an inner wall of a tubular in the well;

(d) setting the upper packer to anchor and seal against the inner wall of the tubular in the well;

(e) producing the well;

(f) running a tool and severing a tubular section in the upper packer to unset the upper packer;

(g) pulling the secondary string to unset the lower packer and retrieve the packer assembly;

characterised in that:

the upper packer is set by applying pressure to the primary string;

the lower packer is set by applying pressure to the secondary string; and the tool is run in the primary string and severs a tubular section of the primary string.

18. A method according to claim 17 wherein the upper packer comprises:

a substantially cylindrical body having a first bore therethrough, an upper connector at a first end of the first bore for connection to an upper mandrel of the primary string and a lower connector at a second end of the first bore for connection to a lower mandrel of the primary string, the primary string having a primary bore and the first bore being considered as a portion of the primary bore;

a packing element positioned around the body;

an anchoring arrangement positioned around the body;

a setting mechanism which causes the anchoring arrangement and the packing element to move relative to the body to engage and seal the packer to the inner wall of the tubular in the well;

a release mechanism which causes the anchoring arrangement and packing element to move relative to the body and disengage the packer from the tubular;

and characterised in that:

the release mechanism comprises:

a sleeve mounted around the body and extending over a portion of a thin-walled section of tubing bounding the primary bore to create an annular chamber between the sleeve and the thin walled section of tubing; the sleeve being connected to the body at an upper end by an engagement mechanism;

the engagement mechanism including biasing means to hold the portion of the thin-walled section of tubing in tension with respect to the sleeve;

wherein:

on severing of the thin-walled section of tubing, the biasing means acts to cause release of the tension and the engagement mechanism so as to move the sleeve, the anchor arrangement and the packing element relative to the body and thereby unset the packer.

19. A method according to claim 18 wherein the tool is a cutting tool and the primary string is severed by cutting through a thin-walled section of tubing.

20. A method according to claim 18 wherein the tool is a shifting tool and the primary string is severed by releasing an interlocking sleeve between separate upper and lower portions of the primary string.

* * * * *